US006638076B2

(12) United States Patent
Wang

(10) Patent No.: US 6,638,076 B2
(45) Date of Patent: Oct. 28, 2003

(54) PLUG/SOCKET ASSEMBLY

(76) Inventor: Donglei Wang, 1-415, Lu Yuan, No. 16 Renmin West Road, Zhuhai, Guangdong Province 519060 (CN)

( * ) Notice: Subject to any disclaimer, the term of this patent is extended or adjusted under 35 U.S.C. 154(b) by 50 days.

(21) Appl. No.: 10/076,690

(22) Filed: Feb. 14, 2002

(65) Prior Publication Data

US 2002/0123250 A1 Sep. 5, 2002

(30) Foreign Application Priority Data

Feb. 14, 2001 (CN) ..... 01215206

(51) Int. Cl.[7] ..... H01R 11/30
(52) U.S. Cl. ..... 439/39
(58) Field of Search ..... 439/38, 39, 446, 439/455

(56) References Cited

U.S. PATENT DOCUMENTS 2,695,390 A 11/1954 Woolston
3,079,579 A 2/1963 Crimmins
3,082,398 A 3/1963 Valach
3,152,856 A 10/1964 Batcheller
3,202,955 A 8/1965 McKee
3,509,296 A 4/1970 Harshman
3,638,164 A 1/1972 Glance
3,753,207 A 8/1973 Maheux
3,951,491 A 4/1976 Myslak
4,046,442 A 9/1977 Hutchison
4,264,114 A 4/1981 Chandler
6,283,767 B1 * 9/2001 Sornes ..... 439/69
6,419,519 B1 * 7/2002 Young ..... 439/446
6,435,732 B1 * 8/2002 Asao et al. ..... 385/78
6,527,570 B1 * 3/2003 Hartman et al. ..... 439/180

* cited by examiner

*Primary Examiner*—Lynn Feild
*Assistant Examiner*—Thanh-Tam Le
(74) *Attorney, Agent, or Firm*—Nydegger & Associates

(57) ABSTRACT

A plug/socket assembly includes a plug portion and a socket portion. The plug portion comprises a fastener, a metal plate set in the fastener, and two contact poles. The socket portion comprises a casing, a lead, two elastic flakes, two magnetic bodies and a lead connector. When the plug portion and socket portion are used together, the magnetic bodies and the elastic flakes contact the metal plate and the contact poles at the same time, respectively.

11 Claims, 2 Drawing Sheets

PLUG/SOCKET ASSEMBLY

FIELD OF THE INVENTION

The invention relates to an attachment of a household appliance, particularly to a plug/socket assembly of a household appliance securing the appliance when the electric power lead thereof is pulled.

BACKGROUND OF THE INVENTION

A conventional plug is always inserted in a socket when a household appliance works. However, when the lead connected to the socket is incautiously pulled, it usually gives rise to the appliance's overturn for the reason that the connection between the plug and socket is too tight. As a result, the staff being cooked in the appliance inevitably spills out, especially in case the staff is liquid.

Therefore, the present invention is to provide a plug/socket assembly to overcome the drawbacks in the prior art. The plug portion attached to the appliance may readily be separated from the socket portion when a force is applied to the socket portion in accordance with the present invention so as to avoid overturning the appliance.

SUMMARY OF THE PREFERRED EMBODIMENTS

A plug/socket assembly according to the present invention includes a plug portion and a socket portion. The plug portion comprises a fastener connected to a household appliance, a metal plate set in the fastener; and two contact poles mounted to the fastener with a front end connected to a heat circuit of the household appliance and a back end extending out of the fastener.

The socket portion comprises a casing, a lead, two elastic flakes, two magnetic bodies and a lead connector. The casing includes an upper cover, a lower cover and two contact holes formed at their joint. The lead is connected to a power supply and the elastic flakes respectively by its inner end and outer end, wherein each elastic flake is set in the casing respectively against the two contact holes. Both of the two magnetic bodies positioned in the casing have an end extending out of the casing. The lead connector connecting to the lead causes an angle formed between the joint direction of the plug and socket portions and the outer end of the lead.

When the plug portion and socket portion are used together, the magnetic bodies and the elastic flakes contact the metal plate and the contact poles at the same time, respectively.

In an embodiment of the present invention, a plurality of projects may be arranged on the fastener to support the socket portion when it rotates, and the fastener may be fastened on the appliance with the contact poles. A magnet may be positioned between the two magnetic bodies, which may be set between the contact holes. Some slots may be set at the upper and lower end edge of the magnetic body to make the slots associate with the corresponding protuberances on the upper and lower cover for fixing the magnetic bodies inside the casing. The lead connector may be made of rigid materials, sleeved on the lead, and fixed on the lead-connected end of the casing. As a result, an angle from approximately 5° to approximately 135° is formed between the outer end of the lead and the horizontal direction to make the plug portion depart from the socket portion readily when a force is applied to the lead. The lead connector may include a circular slot in order to pass through and have itself be fastened in the casing.

According to the present invention, each end of said elastic flakes facing the contact hole may involve a round touch point for conveniently contacting the contact poles.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

The invention will be described in details with the following embodiments in conjunction with the accompanying drawings.

Figure 4:
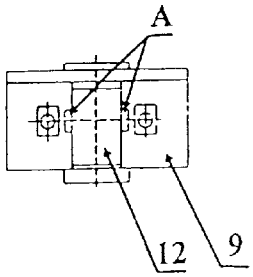
FIG. 4 is an enlarged partial view of the projects arranged on the fastener according to the invention.

FIGS. 1, 2*a*, 2*b* and 4, illustrate a plug and a socket according to one embodiment of the present invention, which includes a plug portion and a socket portion. The plug portion comprises a fastener (9), a metal plate (12) and two contact poles (8). The fastener (9), which is connected to a household appliance, and is made of rigid materials, involves projects A (as shown in FIG. 4) and a recess (not shown in the figures) in the middle of the fastener (9) in which the metal plate (12) may be inserted and matched therewith. Two projects A in this embodiment are respectively positioned at two sides of the recess. The metal plate (12) is removably fixed to the fastener (9) and the central portion thereof is exposed. Out of the two sides of recess are provided the two contact poles (8) through the fastener (9). Two touch points (7) are respectively at one end of the contact poles (8). The other end of the contact poles (8) are connected to a heating circuit of the appliance. In this embodiment, the contact poles (8) are secured to the fastener (9) by screw nuts (10). Numeral reference (11) in FIG. 1 refers to a spring ring to adjust the tightness between the contact poles (8) and the appliance.

The socket portion comprises a casing including an upper cover (2) and a lower cover (13). Two contact holes (22) are formed at a first joint of the upper cover (2) and the lower cover (13). A lead (17), two elastic flakes (3), two magnetic bodies (5) and a lead connector (16) are positioned within the casing. The upper cover (2) is joined with the lower cover (13) in a conventional manner, such as using a Philips screw (1) and a hexagonal nut (14) between which a spring washer (15) is set to adjust the tightness thereof. The magnetic bodies (5) may be made of magnetic materials. In this embodiment, two metal sheets and a magnet (6) attached thereto are used instead of the magnetic bodies. There are a plurality of protuberances (19) arranged in the upper cover (2) and the lower cover (13) to correspond to slots (18) at the end of the magnetic bodies (5) for securing magnetic bodies (5) to the casing. The lead (17), one end connected to a power supply via the lead connector (16), is connected to two elastic flakes (3). The elastic flake (3) facing the contact holes (22) is of a round touch point (4).

Figure 1:
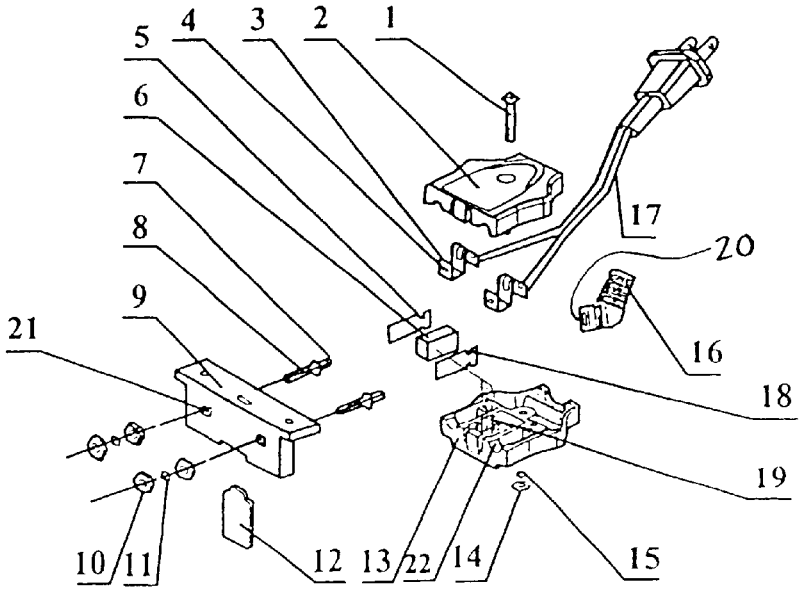
FIG. 1 is a sectional exploded view of an embodiment according to the present invention.
Figure 2A:
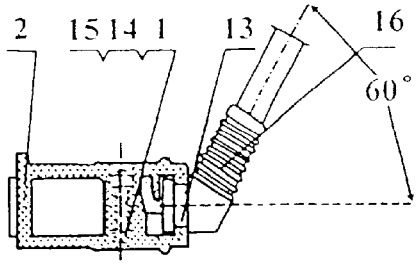
FIG. 2*a* is a longitude sectional view of the casing according to the invention.
Figure 2B:
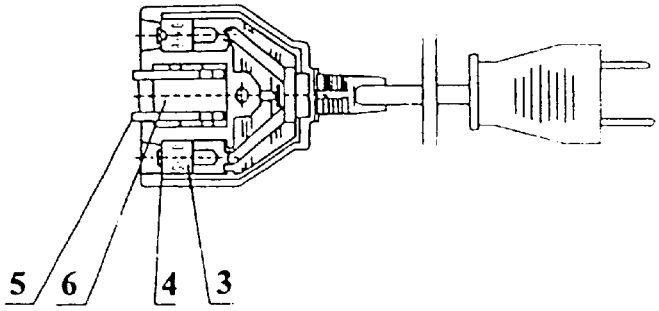
FIG. 2*b* is a transverse sectional view of the casing according to the invention.
Figure 3:
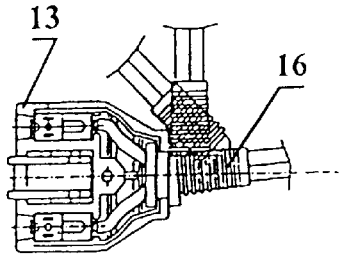
FIG. 3 is a schematic view of the lead connector in different gradient according to the invention.

As shown in FIG. 3, the lead connector (16) made of rigid materials embraces the lead (17), and extends to incline to the interface between the plug portion and socket portion (the horizontal direction) in an angle. As a result, an angle of 60° is formed between the outer end of the lead (17) and the horizontal direction. The lead connector (16) also includes a circular slot (20) (shown in FIG. 1) to pass through and be fastened in the casing.

As shown in FIG. 4, while the plug matches the socket, the magnetic body (5) attracts the metal plate (12). The magnetism F2 depends on the contact area between the plate (5) and the body (12). At this time, the two contact poles (8) are respectively inserted in the contact holes (21), to make the round touch points (4) on the elastic flakes (3) contact the touch points (7) on the contact poles (8). As a result, the household appliance is electrically heated. When an exterior force F1 is exerted on the lead (17), a torsion M1 around the projects A presents on the interface between the plug and socket portion. Meanwhile, a torsion M2 corresponding to the magnetism F2 around the projects A is also generated. However, the force arm of M2 is decreased in the presence of the projects A and the angle, so that the socket portion rotates to lessen the contact area. Thus, F2 becomes weaker, and F1 can overcome F2 to separate the plug portion from the socket portion.

Figure 5:
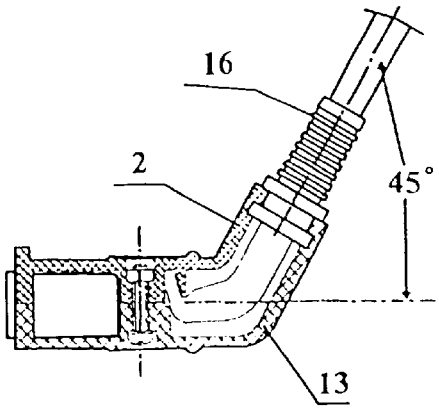
FIG. 5 is a longitude sectional view of a casing of flexural shape of another embodiment according to this invention.

FIG. 5 shows another embodiment according to the present invention. In this embodiment, the upper cover (2) and lower cover (13) are of a suited flexural shape. A part of the lead connector (16) inside the casing fits the flexural shape. As a result, an angle of approximately forty-five degrees (450) is formed between the outer end of the lead (17) and the horizontal direction to make the plug portion depart from the socket portion readily when a force is applied.

While the particular Plug/Socket Assembly as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

I claim:

1. A plug/socket assembly comprising:

a plug portion having a fastener connected to a household appliance having a heat circuit, a metal plate set in said fastener, and two contact poles fixed to said fastener, wherein each said contact poles has a first end and a second end, and further wherein said first ends of said respective contact poles are connected to said heat circuit of said household appliance, and said second ends of said contact poles extend from said fastener; and a socket portion having a casing with an upper cover and a lower cover, two elastic flakes positioned in said casing, two magnetic bodies positioned in said casing, a lead connector attached to said casing, and a lead positioned in said lead connector, wherein said upper cover is connected to said lower cover at a first joint and a second joint, and said casing being formed with two contact holes at said first joint, further wherein said two elastic flakes are positioned in said casing to respectively face said two contact holes, and said lead connector is positioned at said second joint of said casing, wherein said lead extends through said lead connector from said casing at an angle, and further wherein while said magnetic bodies of said socket portion contact with said metal plate of said plug portion, said elastic flakes of said socket portion contact with said second ends of said contact poles of said plug portion.

2. The plug/socket assembly according to claim 1 further comprising two projects positioned near said metal plate on said fastener.

3. The plug/socket assembly according to claim 1 further comprising a magnet positioned between said magnetic bodies of said socket portion.

4. The plug/socket assembly according to claim 3 wherein said magnetic bodies are positioned between said two contact holes of said casing.

5. The plug/socket assembly according to claim 4 wherein each said magnetic body has a first end and a second end, and each said end is formed with a plurality of slots, and further wherein each said upper cover and said lower cover of said casing is formed with a respective plurality of corresponding protuberances, wherein said slots of said magnetic bodies receive said corresponding protuberances of said casing to fasten said magnetic bodies to said casing.

6. The plug/socket assembly according to claim 1 wherein said lead connector is made of rigid materials.

7. The plug/socket assembly according to claim 6 wherein said lead connector includes a circular slot to match said upper cover and said lower cover of said casing.

8. The plug/socket assembly according to claim 1 wherein said angle is in a range between approximately 5° to approximately 135°.

9. The plug/socket assembly according to claim 1 wherein each said elastic flake includes a round contact project positioned towards said contact holes of said casing.

10. The plug/socket assembly according to claim 1 wherein said fastener is fastened to said household appliance by said contact poles.

11. The plug/socket assembly according to claim 1 wherein said upper cover and said lower cover of said casing are flexural-shaped.

* * * * *